US007562484B2

(12) United States Patent
Kim

(10) Patent No.: US 7,562,484 B2
(45) Date of Patent: Jul. 21, 2009

(54) CLAMP MOUNT

(75) Inventor: Paul Y. Kim, Santa Ana, CA (US)

(73) Assignee: Surefire, LLC, Fountain Valley, CA (US)

( * ) Notice: Subject to any disclaimer, the term of this patent is extended or adjusted under 35 U.S.C. 154(b) by 295 days.

(21) Appl. No.: 11/435,203

(22) Filed: May 16, 2006

(65) Prior Publication Data

US 2007/0266612 A1 Nov. 22, 2007

(51) Int. Cl.
*F41G 1/32* (2006.01)

(52) U.S. Cl. ..... 42/114; 42/127; 42/146; 362/110; 411/433; 24/282

(58) Field of Classification Search ..... 42/146, 42/127, 128, 114, 115, 116, 117; 362/110, 362/113, 114; 285/410, 411; 411/433; 24/280, 24/281, 282
See application file for complete search history.

(56) References Cited

U.S. PATENT DOCUMENTS 2,447,892 A * 8/1948 Baliff ..... 362/396
2,601,613 A * 6/1952 Jahncke ..... 248/229.15
2,659,954 A 11/1953 Woolsey
2,717,447 A * 9/1955 Leupold ..... 42/127
2,775,806 A * 1/1957 Love ..... 24/271
2,876,027 A 3/1959 Sulmonetti
3,201,156 A 8/1965 Coats
3,750,318 A 8/1973 Burris
3,828,403 A 8/1974 Perrin et al.
3,964,774 A 6/1976 Wollin et al.
4,074,402 A 2/1978 Taketani
4,079,970 A 3/1978 Brett
4,093,283 A 6/1978 Weinhold
4,123,095 A 10/1978 Stehlin
4,272,871 A 6/1981 Weinhold
4,310,980 A 1/1982 Pilkington
4,429,468 A 2/1984 Jimenez et al.
4,446,644 A 5/1984 Jimenez et al.
4,566,819 A * 1/1986 Johnston ..... 403/385
4,639,979 A 2/1987 Polson
D293,206 S 12/1987 Beaty et al.
4,756,111 A 7/1988 Lapier
D298,739 S 11/1988 Richards, Jr.
4,894,941 A 1/1990 Karow, Jr.
4,919,453 A 4/1990 Halling et al.
4,941,277 A 7/1990 Lawlor
D323,454 S 1/1992 Wiley
5,086,566 A 2/1992 Klumpp
5,144,546 A 9/1992 Burdi
5,415,435 A 5/1995 Colbert
5,540,465 A 7/1996 Sisk
5,560,703 A 10/1996 Capps, III
5,590,484 A 1/1997 Mooney et al.
5,653,481 A 8/1997 Alderman
5,660,363 A 8/1997 Maglica (Continued)

OTHER PUBLICATIONS

SureFire, "2002 Surefire Weaponlight Catalog", pp. 34, 42, and 48-50, 2002.

(Continued)

*Primary Examiner*—Stephen M Johnson

(57) ABSTRACT

Accessory mounting apparatus for a gun, the apparatus including a size-adjustable and quick-release clamp for holding an accessory.

9 Claims, 4 Drawing Sheets

U.S. PATENT DOCUMENTS

| | | | |
|---|---|---|---|
| 5,680,725 | A | 10/1997 | Bell |
| D391,335 | S | 2/1998 | Bechtel |
| 5,787,630 | A | 8/1998 | Martel |
| 5,816,683 | A | 10/1998 | Christiansen |
| 5,826,363 | A | 10/1998 | Olson |
| 5,988,694 | A | 11/1999 | Brushaber |
| 6,023,875 | A | 2/2000 | Fell et al. |
| 6,050,615 | A | 4/2000 | Weinhold |
| D447,532 | S | 9/2001 | Keng |
| 6,425,561 | B2 | 7/2002 | Wooten et al. |
| 6,470,538 | B2 | 10/2002 | Richter |
| 6,565,226 | B1 | 5/2003 | Cummings |
| 6,598,333 | B1 | 7/2003 | Randazzo et al. |
| 6,629,381 | B1 | 10/2003 | Keng |
| D483,431 | S | 12/2003 | Squillante et al. |
| 6,722,076 | B2 | 4/2004 | Nielsen |
| 6,732,987 | B2 | 5/2004 | Wooten et al. |
| D492,977 | S | 7/2004 | Squillante et al. |
| 6,761,467 | B2 | 7/2004 | Matthews et al. |
| 6,851,214 | B2 | 2/2005 | Oz |
| D505,177 | S | 5/2005 | Fell et al. |
| 6,923,412 | B2 | 8/2005 | Wooten et al. |
| 6,994,449 | B2 | 2/2006 | Kim |

OTHER PUBLICATIONS

United States Department of Defense, "Military Standard: Dimensioning of Accessory Mounting Rail for Small Arms Weapons" MIL-STD-1913, Feb. 3, 1995.

* cited by examiner

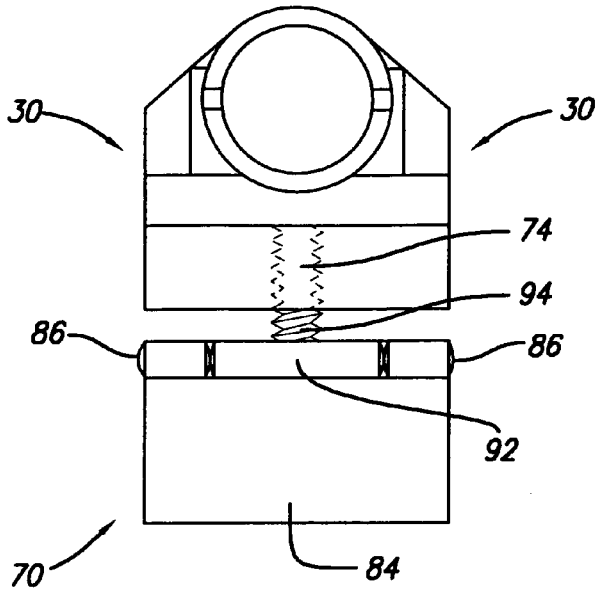
FIG. 5
FIG. 6
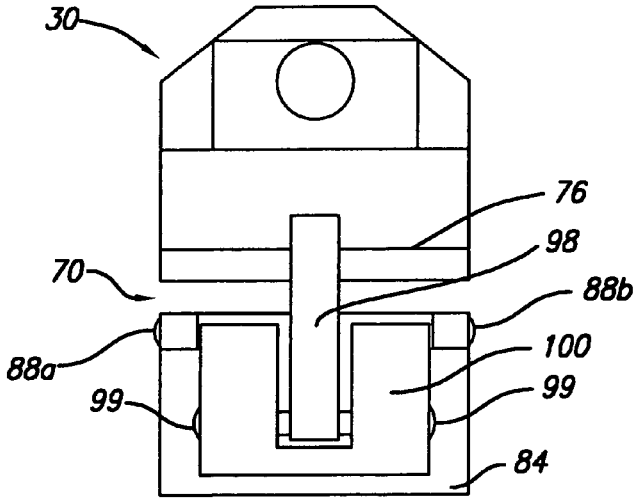
FIG. 7
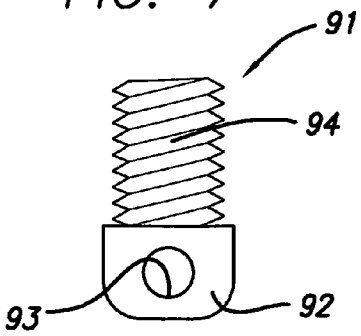
FIG. 8
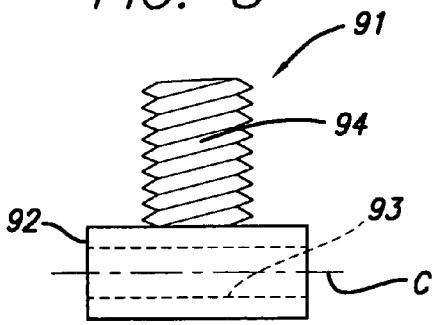

CLAMP MOUNT

BACKGROUND OF THE INVENTION

This invention relates to apparatus for mounting an accessory to a firearm or other type of gun, and more particularly to a gun mount including a size-adjustable and quick-release clamp for holding an accessory.

Mounts for securing a firearm accessory to a firearm are well known, particularly with respect to light beam generator accessories such as flashlights. Such mounts may include a component for securing the mount to the firearm and a clamping component to secure the accessory to the mount.

In certain situations, it may be desirable to use the same mount apparatus with different accessories of the same general shape but which may vary somewhat in size. For example, several flashlights or other generally cylindrically shaped accessories may have slight yet significant variation in the diameter of their housings, and it may be convenient to utilize the same mount apparatus to quickly remove one such flashlight and quickly install another such flashlight of a different diameter. A need exists for a gun mount that would efficiently implement these ends.

SUMMARY OF THE INVENTION

Against this background, the present invention provides apparatus directed to a gun mount including a size-adjustable and quick-release clamp for securing an accessory to the gun. The accessory may comprise a light beam generator such as a flashlight or laser sight, for example. The clamp mount of the present invention is mountable to substantially any type of gun, including a firearm such as a long arm or a handgun, or an air gun. The clamp device of the present invention may be opened, adjusted and closed, without the use of any tools. The adjustability of the clamp device permits the clamp to accommodate flashlights and other generally cylindrically shaped accessories of different diameters.

According to one aspect of the present invention, there is provided apparatus for securing an accessory to a gun comprising: a structural member configured with a first mounting component and a first clamping component; a second mounting component adapted to cooperate with the first mounting component for mounting the structural member to the gun; and a second clamping component pivotally secured to the structural member and adapted to cooperate with the first clamping component for clamping the accessory to the structural member. The second clamping component is pivotable about the pivotal securement of the second clamping component to the structural member for permitting the accessory to be received by and removed from the first and second clamping components.

The clamp mount preferably includes an adjusting device at its pivotal securement of the second clamping component to the structural member for adjusting separation between the first and second clamping components. The adjusting device may include a threaded shaft extending from one of the second clamping component and the structural member; and a threaded bore in the other of the second clamping component and the structural member, the threaded shaft threadedly engaging the threaded bore for permitting the second clamping component to be threadedly and unthreadedly rotated about the securement of the second clamping component and the structural member for adjusting separation between the first and second clamping components.

According to a preferred embodiment, the adjustment device includes a threaded shaft at an end of the second clamping component; and a threaded bore in the structural member, the threaded shaft threadedly engaging the threaded bore for permitting the second clamping component to be threadedly and unthreadedly rotated with respect to the structural member for adjusting separation between the first and second clamping components. The second clamping component includes a quick-release latch adapted to cooperate with the structural member for quickly latching and unlatching the second clamping component with respect to the first clamping component.

According to another aspect thereof, the second clamping component of the clamp mount preferred embodiment includes an arcuate clamp member, an adjusting screw including a threaded shaft and a head with a bore through the head, and a pivot pin in the bore carried by the arcuate clamp member; and a threaded bore in the structural member, the threaded shaft threadingly engaging the threaded bore for permitting the arcuate clamp member to be threadedly and unthreadedly rotated for adjusting separation between the first and second clamping components.

In the preferred embodiment, the first and second mounting components are adapted for mounting the structural member to a rail secured to the gun.

According to a second preferred embodiment of the clamp mount according to the present invention, the first and second mounting components are adapted for mounting the structural member directly to the barrel of a gun. The first mounting component comprises a third clamping component, and the second mounting component comprises a fourth clamping component; the fourth clamping component is pivotally secured to the structural member and adapted to cooperate with the third clamping component for clamping the structural member to the gun barrel.

BRIEF DESCRIPTION OF THE DRAWINGS

The novel features which are characteristic of the invention, both as to structure and method of operation thereof, together with further objects and advantages thereof, will be understood from the following description, considered in connection with the accompanying drawings, in which preferred embodiments of the invention are illustrated by way of example. It is to be expressly understood, however, that the drawings are for illustration and description only and not as a definition of the limits or scope of the invention.

FIG. 5 is a right side elevation view of the clamp mount of FIG. 3;

FIG. 6 is a left side elevation view of the clamp mount of FIG. 3;

FIG. 7 is a front view of the adjustment screw shown in FIGS. 2-5;

FIG. 8 is a side view of the adjustment screw of FIG. 7; and

DETAILED DESCRIPTION OF THE PREFERRED EMBODIMENTS

In the following description, a specific arrangement, construction, and other details are set forth in order to provide a more thorough understanding of the instant invention. It will be apparent to those skilled in the art that the instant invention may be practiced without these specific details and that other embodiments are within the scope of the instant invention.

Figure 1:
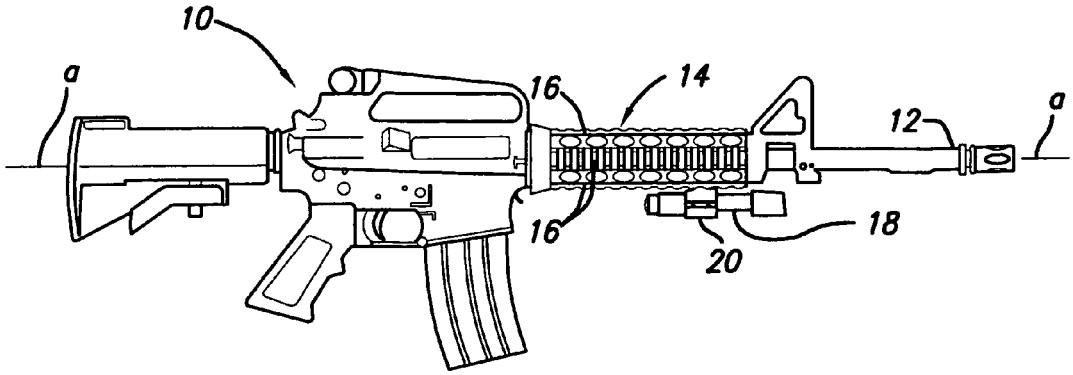
FIG. 1 is a side elevation view of a firearm or gun equipped with a rail apparatus to which a flashlight is mounted by a clamp mount according to the instant invention.

FIG. 1 shows a firearm or gun 10 having a barrel 12 extending along longitudinal axis a, equipped with a rail structure 14 to which a preferred embodiment of a clamp mount 20 according to the instant invention is mounted together with an accessory such as a flashlight 18 or other light beam generator clamped by the clamp mount 20. Such rail structures may be of a type well known in the firearms art for mounting accessories such as weapon lights to a firearm. Examples of such rail structures may be of a type disclosed in U.S. Pat. No. 5,826,363 of Douglas D. Olson, as well as those disclosed in U.S. Pat. No. 5,590,484 of Aurelius A. Mooney et al., both of which patents are incorporated herein by reference.

One such prior art rail comprises a series of longitudinally spaced-apart ribs 16 as specified in MIL-STD-1913, commonly known as a Picatinny rail and shown in FIG. 1 as a top rail, a side rail and a bottom rail comprising the spaced-apart ribs 16.

Figure 2:
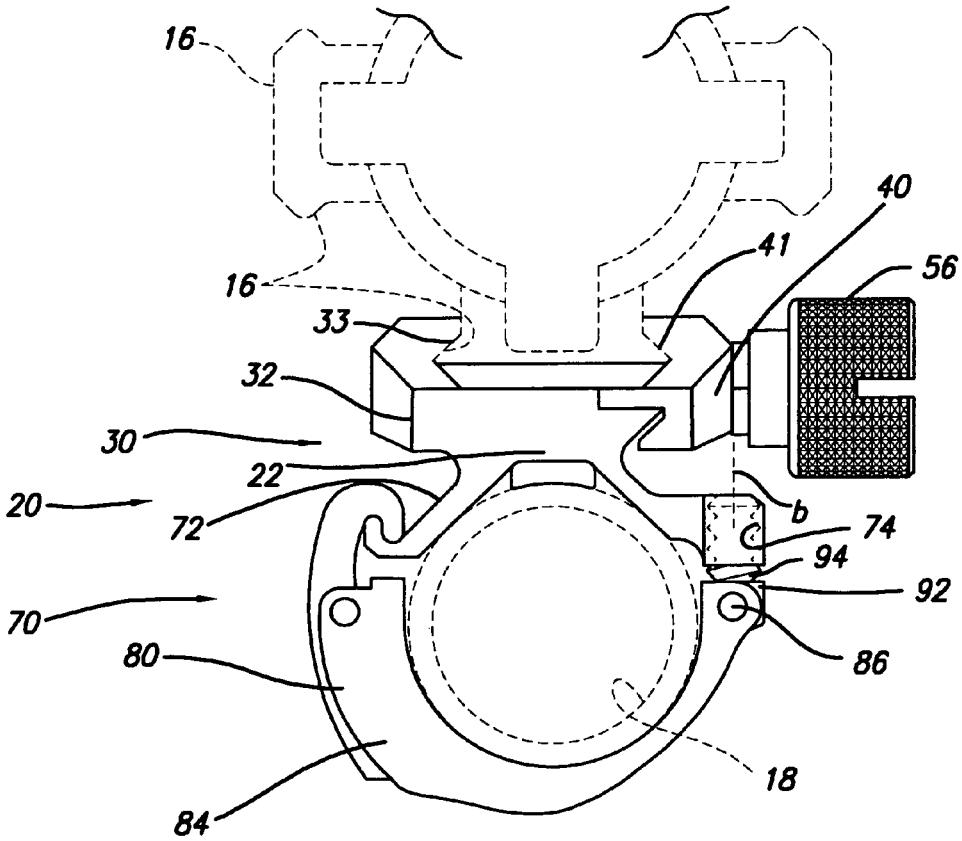
FIG. 2 is, in enlarged scale, a front view of an adjustable clamp mount preferred embodiment according to the instant invention mounted to the rail of FIG. 1 (shown in dashed lines in FIG. 2) and to which an accessory having a generally cylindrical housing (such as the flashlight of FIG. 1, shown in dashed lines in FIG. 2) is mounted.
Figure 3:
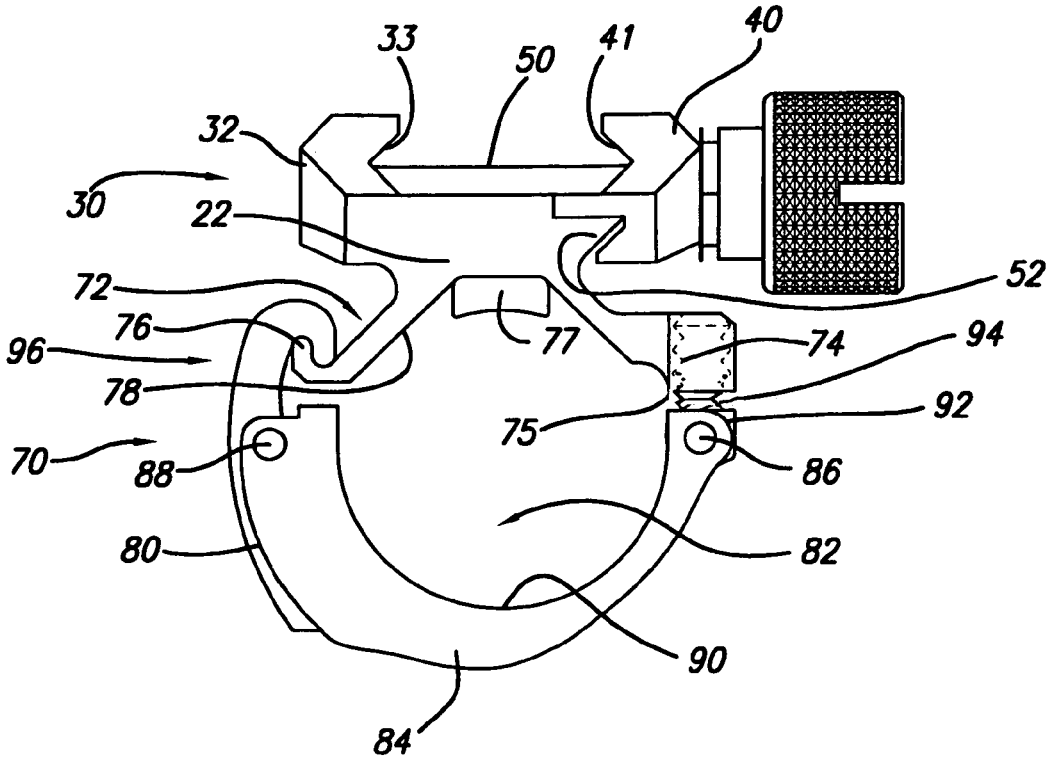
FIG. 3 is a front view of the adjustable clamp mount of FIG. 2.

As can be seen in FIGS. 2 and 3, the clamp mount 20 comprises a structural member 22 configured with a first mounting component 32 at one end and with a first clamping component 72 at the opposite end of the structural member 22. A second mounting component 40 cooperates with the structural member's first mounting component 32, and for this purpose a shaft 50 having a knurled knob 56 at one end and threads at the other end extends through a transverse bore in the second mounting component 40 and threadedly engages a threaded transverse bore in the first mounting component 32. It may be appreciated that, when the structural member 22 and the second mounting component 40 are placed to the rail structure 14 with the first and second mounting components 32, 40 straddling the rail defined by the ribs 16 and with the shaft 50 between adjacent ribs 16, manual rotation of the knurled knob 56 causes the mount's rail engaging surfaces 33 and 41 to clampingly engage the rail and to securely mount the structural member 22 thereto. Loosening rotation of the knurled knob 56 permits the structural member 22 to be removed from the rail. Such rail mounting mechanisms are well known in the art; see, for example, FIG. 2 of U.S. Pat. No. 6,994,449, as well as other Weaver style clamping devices for mounting to a rail structure.

The first mounting component 32 and the second mounting component 40 combine with one another to form a mount 30. The first clamping component 72 and the second clamping component 80 combine with one another to form a clamp 70. The clamp 70 has an opening 82 that can be adjusted to accommodate accessories of different sizes such as generally cylindrical accessories (e.g., flashlight 18) of different diameters.

As seen in FIGS. 2 and 3, the first clamping component 72 comprises a threaded adjustment bore 74 at one end along a transverse axis b (preferably perpendicular to the longitudinal axis a, vertically disposed when the barrel is held horizontally), a catch 76 at the opposite end thereof, and a first inner surface 78 between the two ends preferably including a cushion or pad 77 thereon. A landing surface 75 surrounds the opening of the adjustment bore 74.

The second clamping component 80 comprises an arcuate clamp member 84, a pivot pin 86 (preferably longitudinally disposed when the clamp 70 is in its latched condition shown in FIG. 2) at one end of the arcuate clamp member 84, an adjusting screw 91 including a threaded shaft 94 and a head 92 with a bore 93 (along an axis c preferably perpendicular to the shaft 94, see also FIGS. 7 and 8) through which the pin 86 is situated, a pair of latch pins 88*a* and 88*b* located at the other end of the arcuate clamp member 84, a latch 96, and a second inner surface 90 located opposite the first inner surface 78. The threaded shaft 94 of the adjusting screw 91 threadedly engages the threaded adjustment bore 74 of the first clamping component 72.

The latch 96 comprises a latch plate 100, a latch bar 98, and a latch bar pin 99. The latch 96 is attached to the clamp member 84 via the latch pins 88*a* and 88*b*. The latch 96 can rotate about the latch pins 88*a* and 88*b*. One end of the latch bar 98 is attached to the latch plate 100 via the latch bar pin 99. The latch bar 98 can rotate about the latch bar pin 99. The other end of the latch bar 98 has a hook 108 that engages the catch 76 of the first clamping component 72.

To operate the clamp 70, a user opens the clamp 70 by pulling or flipping the latch plate 100 away from the arcuate clamp member 84, thereby pivoting the latch plate 100 about the longitudinal pivot pin 88. This action causes the longitudinal pivot pin 99 to rotate upwardly and outwardly (as viewed in FIG. 4) about the longitudinal pivot pin 88, in turn causing the latch bar 98 to pivot about the pivot pin 99 to unlatch the hook 108 from the catch 76.

Figure 4:
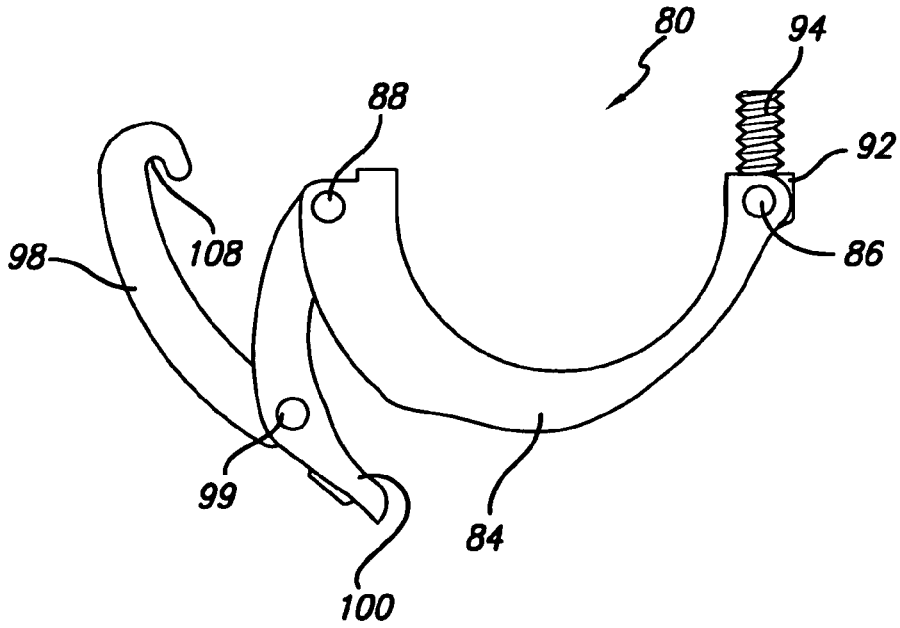
FIG. 4 is a front view of a clamping component of the clamp mount of FIG. 3.

For adjusting the clamp 70, the latch 96 is opened as described above until the hook 108 clears the catch 76. FIG. 4 shows the hook 108 in such an open state where it is sufficiently clear of the catch 76 to allow the clamp 70 to be adjusted. The hook 108 may be further cleared of the catch 76 by pulling the arcuate clamp member 84 away from the catch 76. Pulling the clamp ring 84 in this manner pivots the clamp member 84 about the pivot pin 86. The clamp member 84 may be pivoted in this manner more than 180°.

When the hook 108 is clear of the catch 76, the second clamping component 80 is then rotated by hand with respect to the structural member 22, about the axis b of the threaded bore 74, which is perpendicular to the axis c of the pivot pin 86, thereby correspondingly rotating the adjusting screw 91 and its threaded shaft 94 in the adjustment bore 74. When the second clamping component 80 is rotated in this manner, all of its subcomponents rotate with it, including the latch 96, latch pins 88*a* and 88*b*, screw head pin 86, screw head 92, and threaded screw shaft 94. Rotating the adjusting screw 91 in this manner increases or decreases the distance between the screw head 92 and the landing surface 75. Increasing this distance will increase the size of the clamp opening 82 (i.e., the separation between the first and second clamping components 72 and 80), and decreasing this distance will decrease the size of the clamp opening 82.

After the second clamping component 80 has been rotated until the desired distance between the screw head 92 and landing surface 75 has been achieved, the accessory is then placed to the first clamping component 72, preferably in contact with the pad 77. The pad 77 is preferably resilient, fabricated of an elastomeric material and preferably conforming to the surface of the accessory that is being held in the clamp opening 82. In this manner, the pad 77 helps to maintain a secure fit between the accessory and the clamp 70.

The arcuate clamping member 84 is thereupon pivoted about the pin 86 to capture the accessory 18 (see also FIG. 2)

between the first and second clamping components 72 and 80. The user manipulates the latch 96 to engage the latch hook 108 with the catch 76, and the second clamping component 80 is then clamped onto the captured accessory 18 by the user's pushing the latch plate 100 toward the clamp member 84 until the latch hook 108 fully engages and is captured to the catch 76. At this point, the latch 96 is completely closed.

If the compressive or clamping force at this point is not sufficient to properly hold the accessory in the clamp opening 82, the clamping force can be increased by decreasing the size of the clamp opening 82. The size of the clamp opening 82 is decreased by first opening the latch 96, rotating the second clamping component 80 through 360° to decrease the distance between the screw head 92 and the landing surface 75, and then closing the latch 96. If needed, the clamping force can be decreased by increasing the size of the clamp opening 82. The size of the clamp opening 82 is increased by first opening the latch 96, rotating the second clamping component 80 through 360° to increase the distance between the screw head 92 and the landing surface 75, and then closing the latch 96. The steps of opening the latch 96, adjusting the distance between the screw head 92 and landing surface 75, and closing the latch 96, can be repeated as needed for any accessory until the desired clamping force is achieved for that particular accessory.

The sequence of mounting the mount 30 on a rail and installing an accessory in the clamp 70 need not follow any particular order. The mount 30 may be installed on a rail first followed by installation of the accessory in the clamp 70. Alternatively, the accessory may be installed in a clamp 70 first followed by attachment of the mount 30 to a rail.

Figure 9:
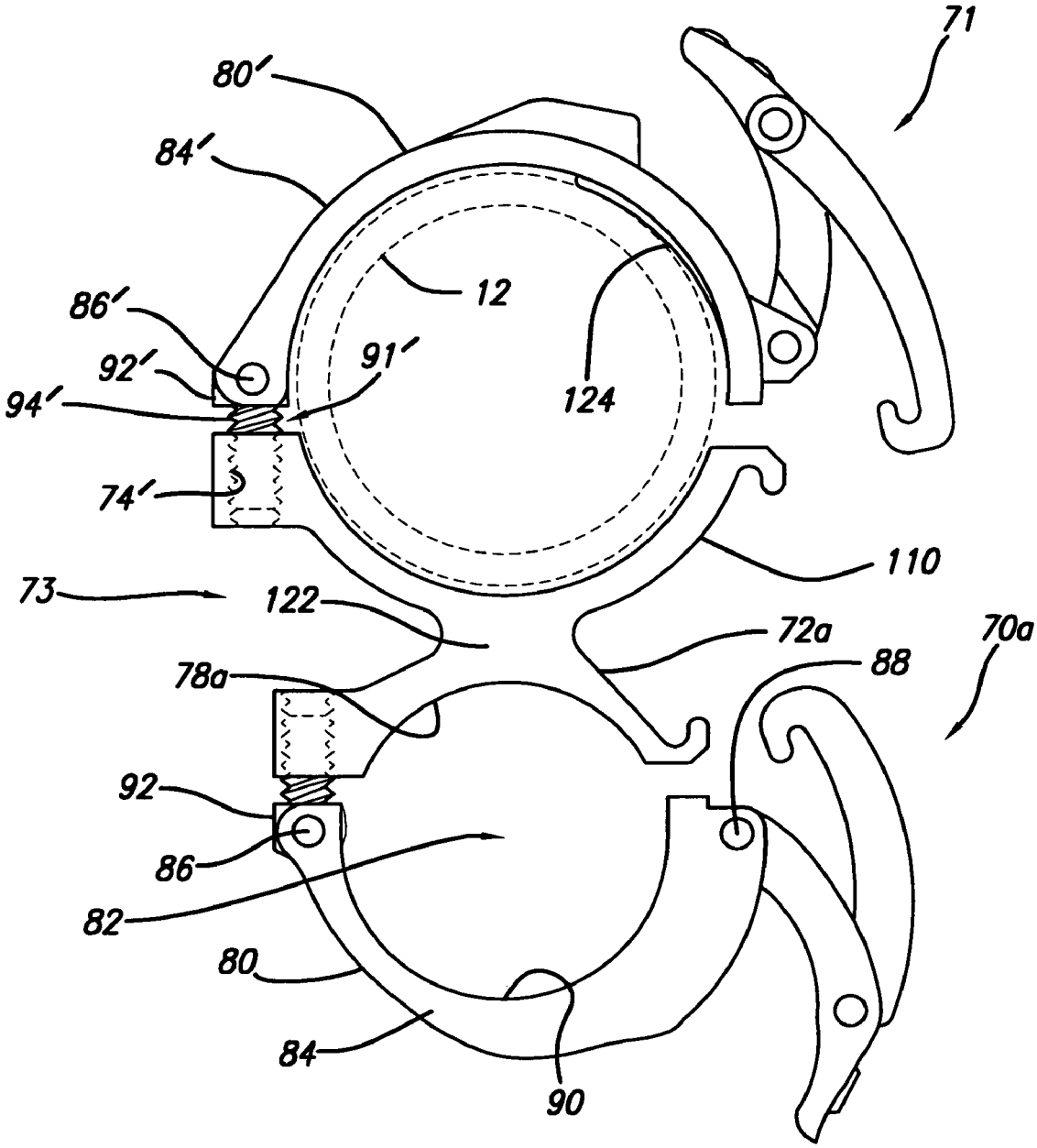
FIG. 9 is a front view of a second preferred embodiment of an adjustable clamp mount according to the instant invention.

In a second preferred embodiment of the instant invention, shown in FIG. 9 (wherein elements with primed reference numerals are substantially structurally and functionally similar to elements of the first preferred embodiment with corresponding unprimed reference numerals), the mount 30 of the clamp mount 20 is in the form of a gun clamp 71 that mounts to the gun 10 by clamping directly about the gun's barrel 12 (see also FIG. 1). The gun clamp 71 is an adjustable, quick-release clamp that embodies substantially similar structure and operates similarly to the accessory clamp 70 previously described. The gun clamp 71 is combined with the clamp 70*a* to form a double clamp apparatus 73.

The clamp mount or double clamp apparatus 73 comprises a structural member 122 having a first mounting (or first gun clamping) component 110 at one end, and a first accessory clamping component 72*a* at the opposite end thereof. The double clamp apparatus 73 further includes a second mounting (or second gun clamping) component 80', and a second accessory clamping component 80. The first gun clamping component (i.e., the third clamping component) 110 and the second gun clamping component (i.e., the fourth clamping component) 80' combine with one another to form the gun clamp 71, which is substantially similar in structure and function to the accessory clamp 70.

The first accessory clamping component 72*a* and the second accessory clamping component 80 combine with one another to form an accessory clamp 70*a*. Clamps 70*a* and 70 embody substantially similar structure and operate substantially in similar manner.

To operate the double clamp 73, the gun clamp 71 is opened as described above for the clamp 70, and the gun clamp 71 is positioned about the gun's barrel 12 with the barrel 12 preferably bearing against an inwardly biased finger 124. The gun clamp 71 is then closed and, if needed, adjusted as described above pertaining to clamp 70. An accessory 18 may be installed in clamp 70*a* substantially as described above with respect to the clamp 70.

The foregoing description is for illustrative purposes only. It will be apparent to those skilled in the art that various changes and modifications can be made to the instant invention without departing from the overall spirit and scope of the instant invention. It is in that context that the following claims are made.

I claim as my invention is:

1. Apparatus for securing an accessory to a gun, comprising:

a gun;

an accessory for said gun;

a structural member configured with a first mounting component and a first clamping component;

a second mounting component adapted to cooperate with said first mounting component for mounting said structural member to said gun;

a second clamping component including a clamp member having an end pivotally secured to said structural member about a first axis for pivoting said second clamping component to cooperate with said first clamping component for clamping the accessory to said structural member;

an adjusting screw including a threaded shaft having an end secured to said end of said clamp member of said second clamping component, said threaded shaft extending along a second axis perpendicular to said first axis; and a threaded bore in said structural member, said threaded bore extending along said second axis and threadedly engaging said threaded shaft for permitting said end of said clamp member of said second clamping component to be rotated about said second axis thereby threading and unthreading said threaded shaft in said threaded bore for adjusting separation between said first clamping component and said second clamping component.

2. The apparatus according to claim 1, wherein:

said end of said threaded shaft includes a head having a bore therethrough along said first axis; and said end of said clamp member of said second clamping component carries a pivot pin extending along said first axis and about which said end of said clamp member of said second clamping component is pivotally secured to said structural member, said pivot pin disposed through said bore through said head.

3. The apparatus according to claim 1, including:

a quick release latch at another end of said clamp member of said second clamping component adapted to cooperate with said structural member for latching and unlatching said second clamping component with respect to said first clamping component.

4. The apparatus according to claim 1, wherein:

said first and second mounting components are adapted for mounting said structural member to a rail secured to said gun.

5. The apparatus according to claim 1, wherein:

said first and second mounting components are adapted for mounting said structural member to a barrel of said gun.

6. The apparatus according to claim 1, wherein:

said first mounting component comprises a third clamping component, and said second mounting component comprises a fourth clamping component; and said fourth clamping component includes a clamp member having an end pivotally secured to said structural member about a pivot axis for pivoting said fourth clamping component to cooperate with said third clamping component for clamping said structural member to a barrel of said gun.

7. The apparatus according to claim 6, including:

a second adjusting screw including a second threaded shaft having an end secured to said end of said clamp member of said fourth clamping component, said second threaded shaft extending along a shaft axis perpendicular to said pivot axis; and a second threaded bore in said structural member, said second threaded shaft threadedly engaging said second threaded bore for permitting said end of said clamp member of said fourth clamping component to be rotated about said second shaft axis thereby threading and unthreading said second shaft in said second threaded bore for adjusting separation between said third clamping component and said fourth clamping component.

8. The apparatus according to claim 7, wherein:

said end of said second threaded shaft includes a head having a bore therethrough along said pivot axis; and said end of said clamp member of said fourth clamping component carries a pivot pin extending along said pivot axis and about which said end of said clamp member of said fourth clamping component is pivotally secured to said structural member, said pivot pin disposed through said bore through said head of said second threaded shaft.

9. The apparatus according to claim 6, including:

a quick release latch at another end of said clamp member of said fourth clamping component adapted to cooperate with said structural member for latching and unlatching said fourth clamping component with respect to said third clamping component.

* * * * *